US010532249B1

(12) United States Patent
Maresh

(10) Patent No.: US 10,532,249 B1
(45) **Date of Patent: *Jan. 14, 2020**

(54) SCUBA PROPULSION APPATATUS HAVING OSCILLATING FINS

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/937,853

(22) Filed: Mar. 27, 2018

Related U.S. Application Data

(60) Provisional application No. 62/601,656, filed on Mar. 27, 2017.

(51) Int. Cl.
*A63B 35/06* (2006.01)
*B63C 11/02* (2006.01)
*B63C 11/46* (2006.01)

(52) U.S. Cl.
CPC ..... *A63B 35/06* (2013.01); *B63C 11/02* (2013.01); *B63C 11/46* (2013.01); *B63C 2011/026* (2013.01)

(58) Field of Classification Search
CPC ..... A63B 35/06; A63B 35/08; A63B 35/10; B63C 11/46; B63C 11/02; B63C 2011/026
USPC ..... 440/21, 25, 26, 27, 31, 32, 13, 14; 441/55
See application file for complete search history.

(56) References Cited

U.S. PATENT DOCUMENTS 3,095,850 A * 7/1963 Stolzer ..... B63H 16/12 440/13
4,472,147 A * 9/1984 Jimenez ..... A63B 35/00 440/17
4,976,423 A * 12/1990 Routti ..... A63B 22/0076 472/128
6,022,249 A * 2/2000 Ketterman ..... B63H 1/36 400/21
6,533,621 B1 * 3/2003 Yang ..... B63C 11/46 440/31
6,964,589 B1 * 11/2005 Lin ..... B63H 16/12 440/103
9,676,459 B1 * 6/2017 Maresh ..... B63H 1/36

* cited by examiner

*Primary Examiner* — Anthony D Wiest
(74) *Attorney, Agent, or Firm* — Nick A Nichols, Jr.

(57) ABSTRACT

In an oscillating fin propulsion apparatus operatively connected to a scuba diver moving on or through a body of water, a propulsive force may be produced by a pair of fins adapted to sweep back and forth in a generally transverse direction relative to the longitudinal axis of the scuba diver's body. The fins may be mounted on opposite sides of a frame detachably secured to a scuba tank. The fins may be rotatable in an oscillatory motion about respective axes coplanar to the center longitudinal axis of the frame. Drive members operable by the scuba diver may be operatively connected to the fins. The oscillating fins may provide a propulsive force to propel the scuba diver longitudinally forward during both oscillating directions of the fins as they sweep back and forth.

9 Claims, 6 Drawing Sheets

SCUBA PROPULSION APPATATUS HAVING OSCILLATING FINS

CROSS-REFERENCE TO RELATED APPLICATION

This application claims priority to and the benefit of the filing date of U.S. Provisional Application Ser. No. 62/601,656, filed Mar. 27, 2017, which application is herein incorporated by reference in its entirety.

BACKGROUND

The present invention relates to a water propulsion apparatus, and more generally, to scuba equipment having thrust generating oscillating fins for underwater propulsion powered by a diver.

Pedal operated propulsion apparatus, such as a foot operated paddle boat described in U.S. Pat. No. 3,095,850, are known in the art. Other pedal operated means linking rotatable pedals to a propeller have been proposed. Some have looked to the swimming motion of sea creatures to design mechanically powered propulsion systems. Generally speaking, the swimming behavior of sea creatures may be classified into two distinct modes of motion: middle fin motion or median and paired fin (MPF) mode and tail fin or body and-caudal fin (BCF) mode, based upon the body structures involved in thrust production. Within each of these classifications, there are numerous swimming modes along a spectrum of behaviors from purely undulatory to entirely oscillatory modes. In undulatory swimming modes thrust is produced by wave-like movements of the propulsive structure (usually a fin or the whole body). Oscillatory modes, on the other hand, are characterized by thrust production from a swiveling of the propulsive structure at the attachment point without any wave-like motion. A penguin or a turtle, for example, may be considered to have movements generally consistent with an oscillatory mode of propulsion.

In 1997, Massachusetts Institute of Technology (MIT) researchers reported that a propulsion system that utilized two oscillating blades of MPF mode produced thrust by sweeping back and forth in opposite directions had achieved efficiencies of 87%, compared to 70% efficiencies for conventional watercraft. A 12-foot scale model of the MIT Proteus "penguin boat" was capable of moving as fast as conventional propeller driven watercraft. Another MIT propulsion system referred to as a "Robotuna," utilized a tail in BCF mode propulsion patterned after a blue fin tuna, achieved efficiencies of 85%. Based upon limited studies, higher efficiencies of 87% (and by some reports 90-95% efficiency) may be possible with oscillatory MPF mode propulsion that may enable relatively long distances of human powered propulsion being achieved both on and under the water surface.

U.S. Pat. No. 6,022,249 describes a kayak having a propulsion system that extends below the water line. The propulsion system includes a pair of flappers in series, each adapted to oscillate through an arcuate path in a generally transverse direction with respect to the central longitudinal dimension of the kayak.

SUMMARY

In an oscillating fin propulsion apparatus operatively connected to a scuba diver moving on or through a body of water, a propulsive force may be produced by a pair of fins adapted to sweep back and forth in a generally transverse direction relative to the longitudinal axis of the scuba diver's body. The fins may be mounted on opposite sides of a frame detachably secured to a scuba tank. The fins may be rotatable in an oscillatory motion about respective axes coplanar to the center longitudinal axis of the frame. Drive members operable by the scuba diver may be operatively connected to the fins. The oscillating fins may provide a propulsive force to propel the scuba diver longitudinally forward during both oscillating directions of the fins as they sweep back and forth.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
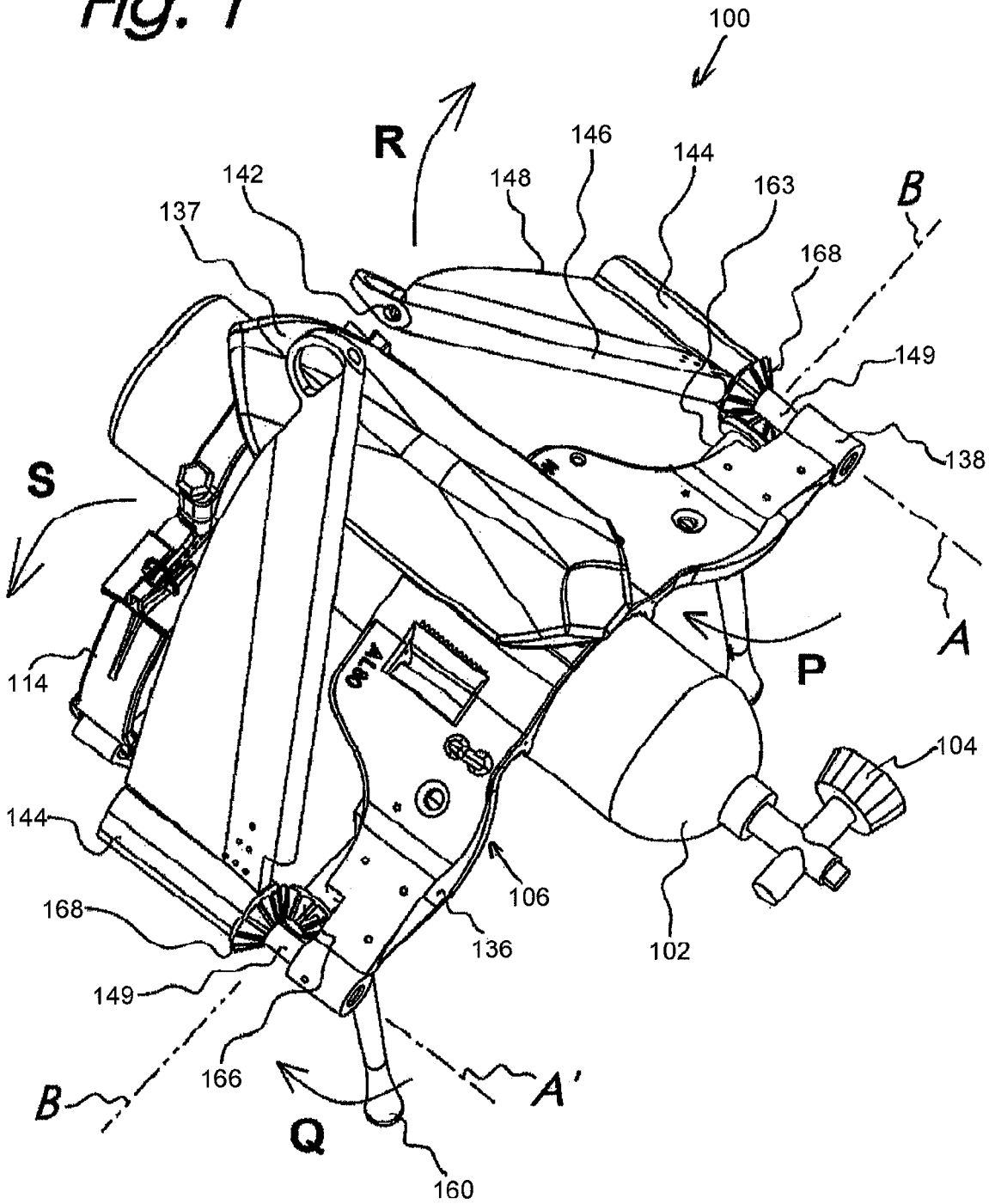
FIG. 1 is a first perspective view of scuba equipment having thrust generating oscillating fins secured to a scuba tank.

Referring first to FIG. 1, an oscillating fin propulsion apparatus generally identified by the reference numeral 100 is shown secured on a scuba air tank 102. The air tank 102 may include a regulator 104, valves, air hose and other associated gear known in the art. The air tank 102 may be secured to a scuba diver by straps and the like known in the art.

The propulsion apparatus 100 may include a clamp frame 106 rigidly secured to the air tank 102. The clamp frame 106 may be generally similar to the clamp frame disclosed in Applicant's U.S. Pat. No. 9,676,459, which patent is herein incorporated by reference in its entirety. Alternatively, but without limitation, the propulsion apparatus 100 may be secured to the air tank 102 with unillustrated straps and/or strap cam clamps.

An optional hip strap assembly 108 may also be secured to the air tank 102. The hip strap assembly 108 may include an elongated rigid base member 110 clamped to a region of the air tank 102 that is offset or spaced from the clamp frame 106 to avoid any interference with the clamp frame 106 of the propulsion apparatus 100. The base member 110 may extend transverse to the longitudinal axis of the air tank 102. Adjustable arms 112 may be movably connected to the opposite distal ends of the base member 110. The arms 112 may terminate in channel brackets 116 at a distal end thereof. The channel brackets 116 may be configured to receive and slid over the opposite distal ends of the base member 110. The arms 112 may further include curved segments 114 projecting downward from the channel brackets 116. The channel brackets 116 may define substantially horizontal channels 115 for receiving oppositely extending flange portions 118 of the base member 110.

The base member 110 may include an upstanding substantially planar rib or ridge 120 projecting outwardly substantially perpendicular to the back surface of the base member 110. The ridge 120 may include a plurality of through holes 122 arranged linearly along the length thereof.

The channel brackets 116 may further include sidewalls 123 defining a substantially vertical channel 124 extending the length of the channel brackets 116. The sidewalls 123 of the channel brackets 116 may include through holes which may be aligned with one of the through holes 122 of the ridge member 120 for receiving a pin 126 therethrough. The channel brackets 116 may be adjusted to accommodate for different body sizes of scuba divers by sliding the arms 112 inwardly or outwardly relative to the base member 110 and inserting pins 126 through aligned holes in the sidewalls 123 of the channel brackets 116 and ridge member 120 projecting into the channel 124. Belt segments 128 may be fixedly attached to distal ends of the curved segments 114 or the arms 112 and buckled about a scuba diver at the belt buckle 130. The hip strap assembly 108 may be strapped about the scuba diver, much like a belt, for minimizing movement of the air tank 102 relative to the scuba diver's body.

Referring now to FIGS. 1-6, collectively, the clamp frame 106 may include a substantially semi-cylindrical intermediate portion 132 and left and right lateral portions 134 and 136 extending outwardly from opposite lateral sides of the intermediate portion 132. For convenience and clarity, the terms "left" and "right" as used herein mean the left and right sides of the scuba diver. The lateral portions 134, 136 of the clamp frame 106 may terminate in shaft bearings 138 at the distal ends thereof.

A ballast float 137 may be fixedly secured to the intermediate portion 132 of the clamp frame 106 to control roll which may occur when the center of buoyancy of the scuba diver and the propulsion apparatus 100 is below the center of gravity. The ballast float 137 may be partially flooded as desired depending upon user preference.

Figure 2:
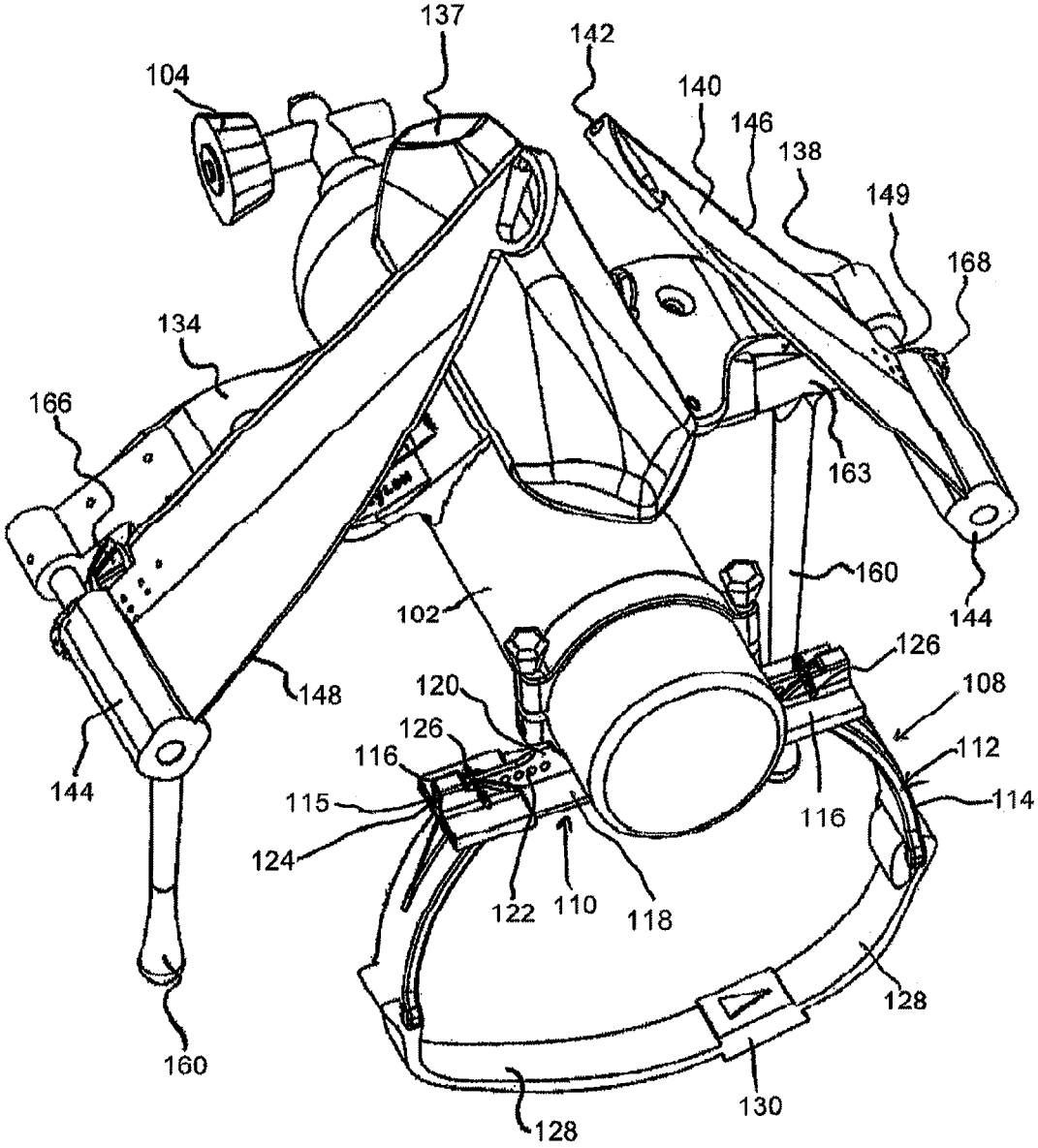
FIG. 2 is a second perspective view of the scuba equipment shown in FIG. 1.
Figure 3:
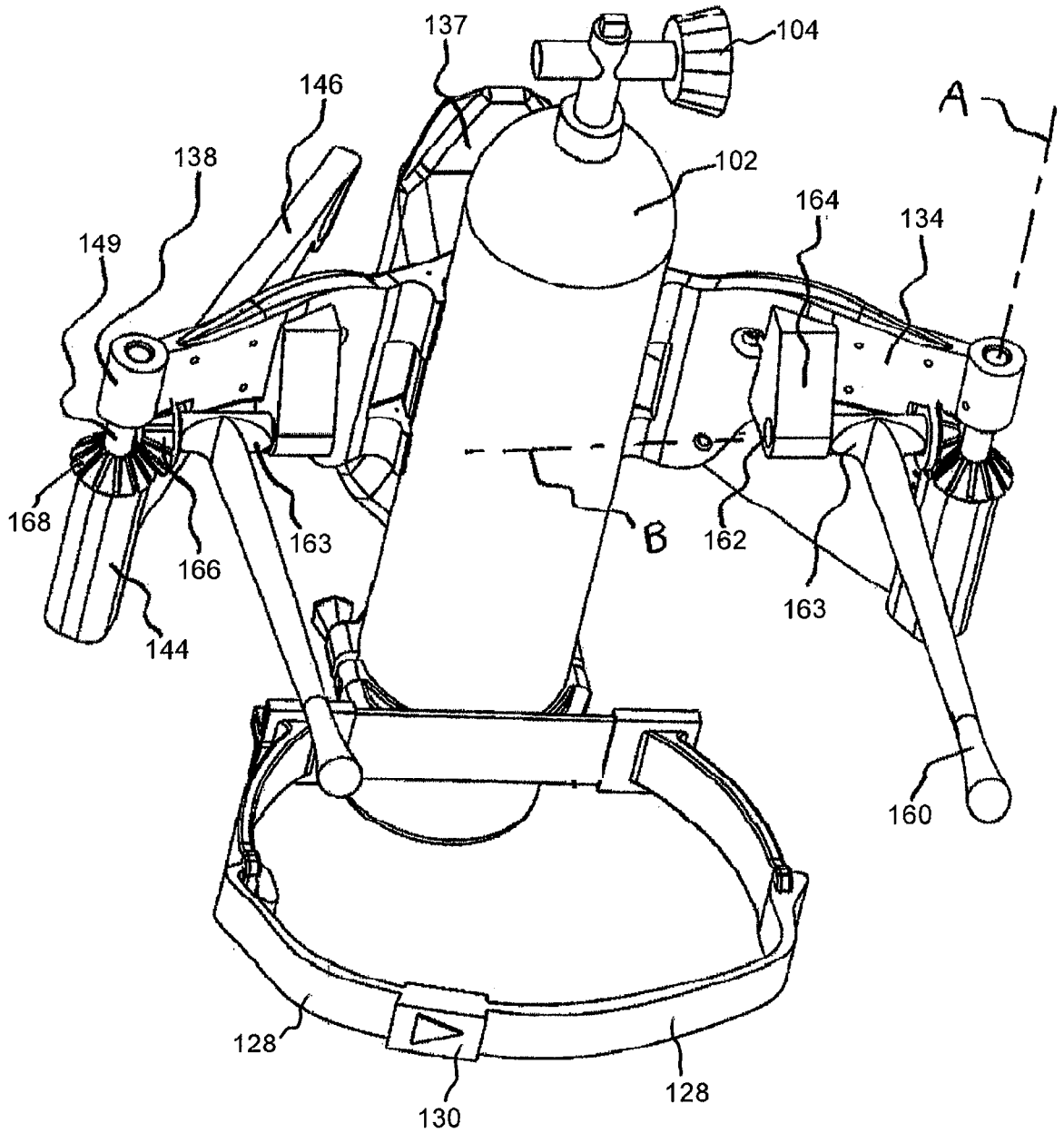
FIG. 3 is a third perspective view of the scuba equipment shown in FIG. 1.
Figure 4:
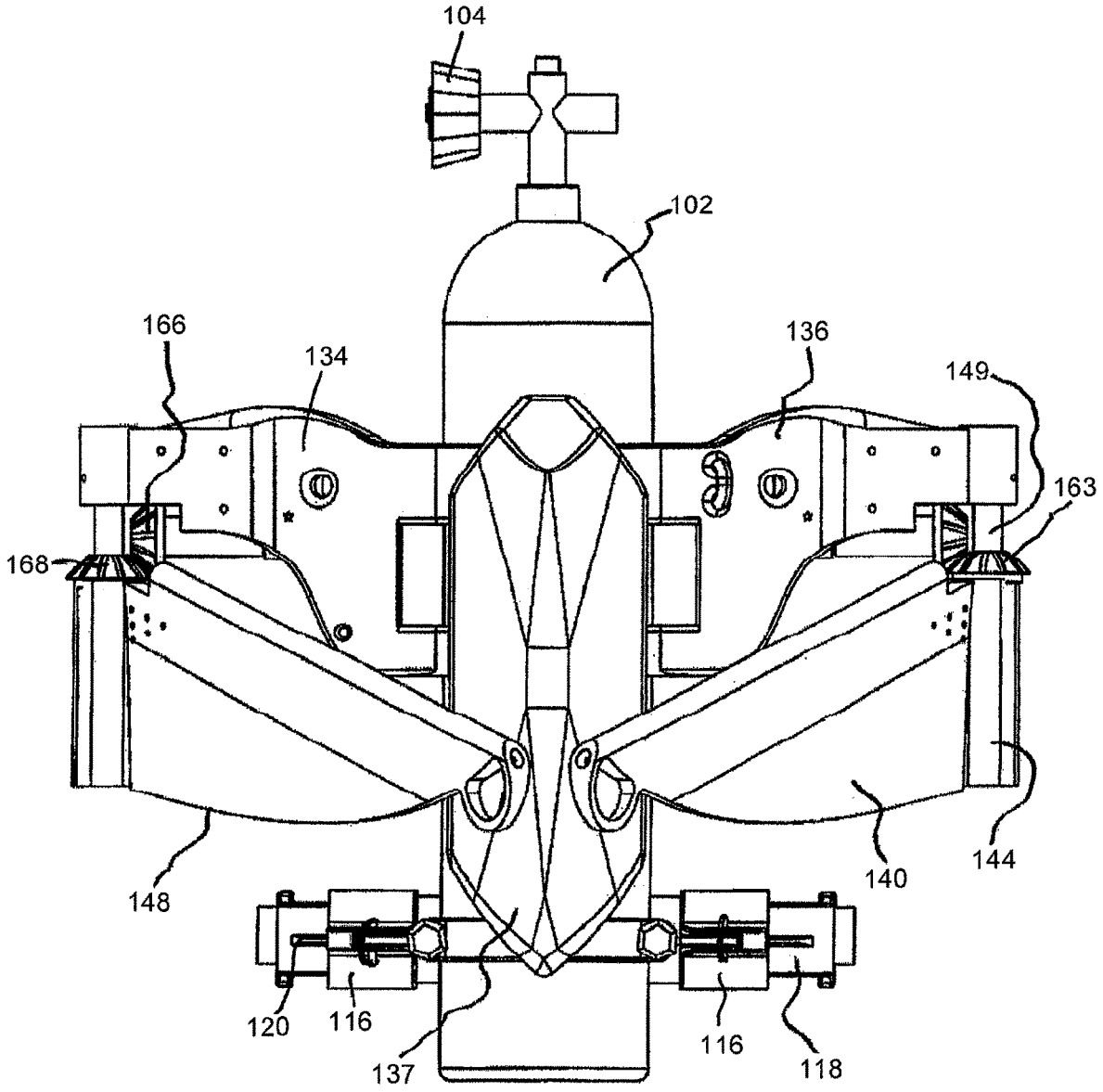
FIG. 4 is a top plan view of the scuba equipment shown in FIG. 1.
Figure 5:
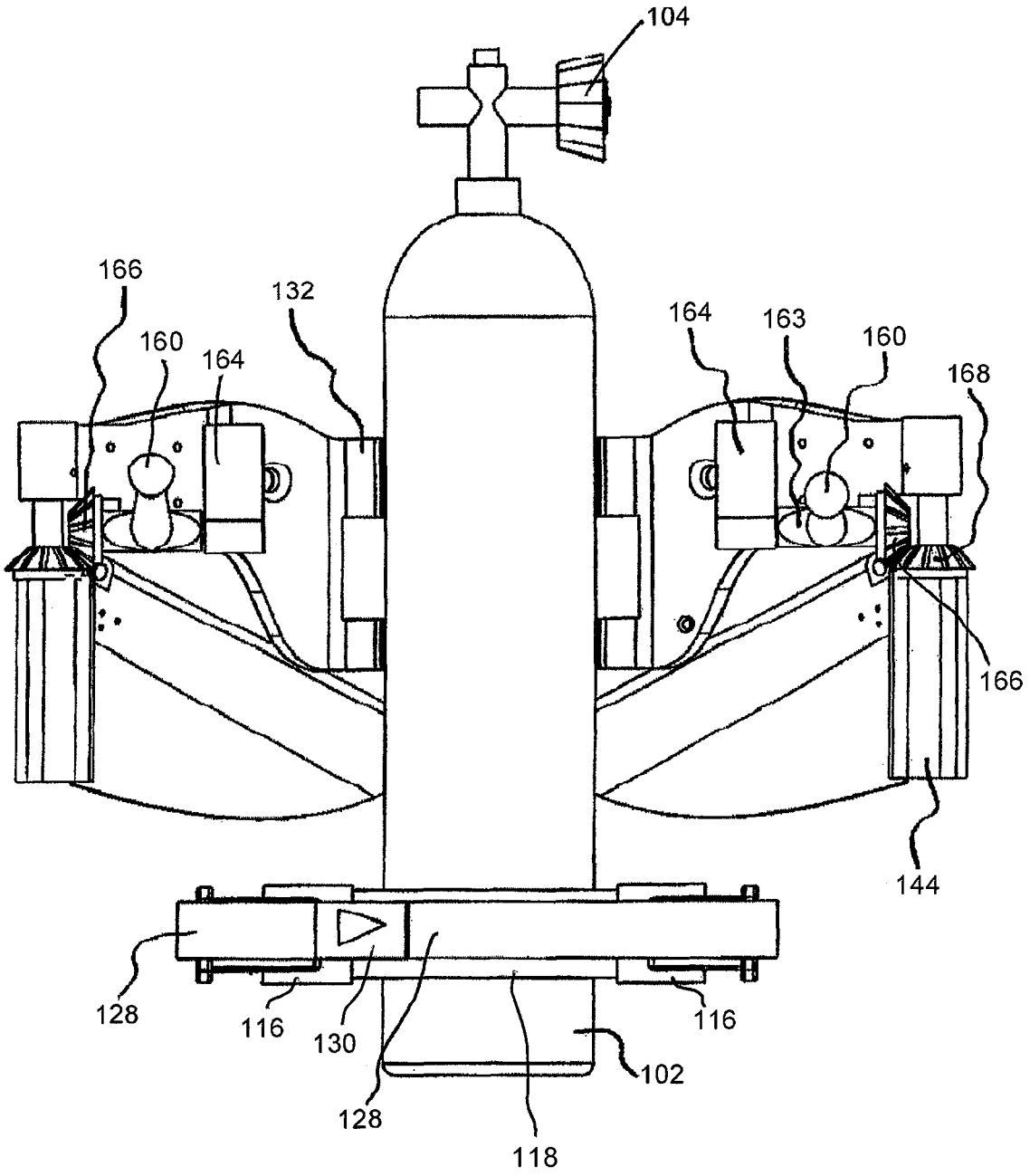
FIG. 5 is a bottom plan view of the scuba equipment shown in FIG. 1.
Figure 6:
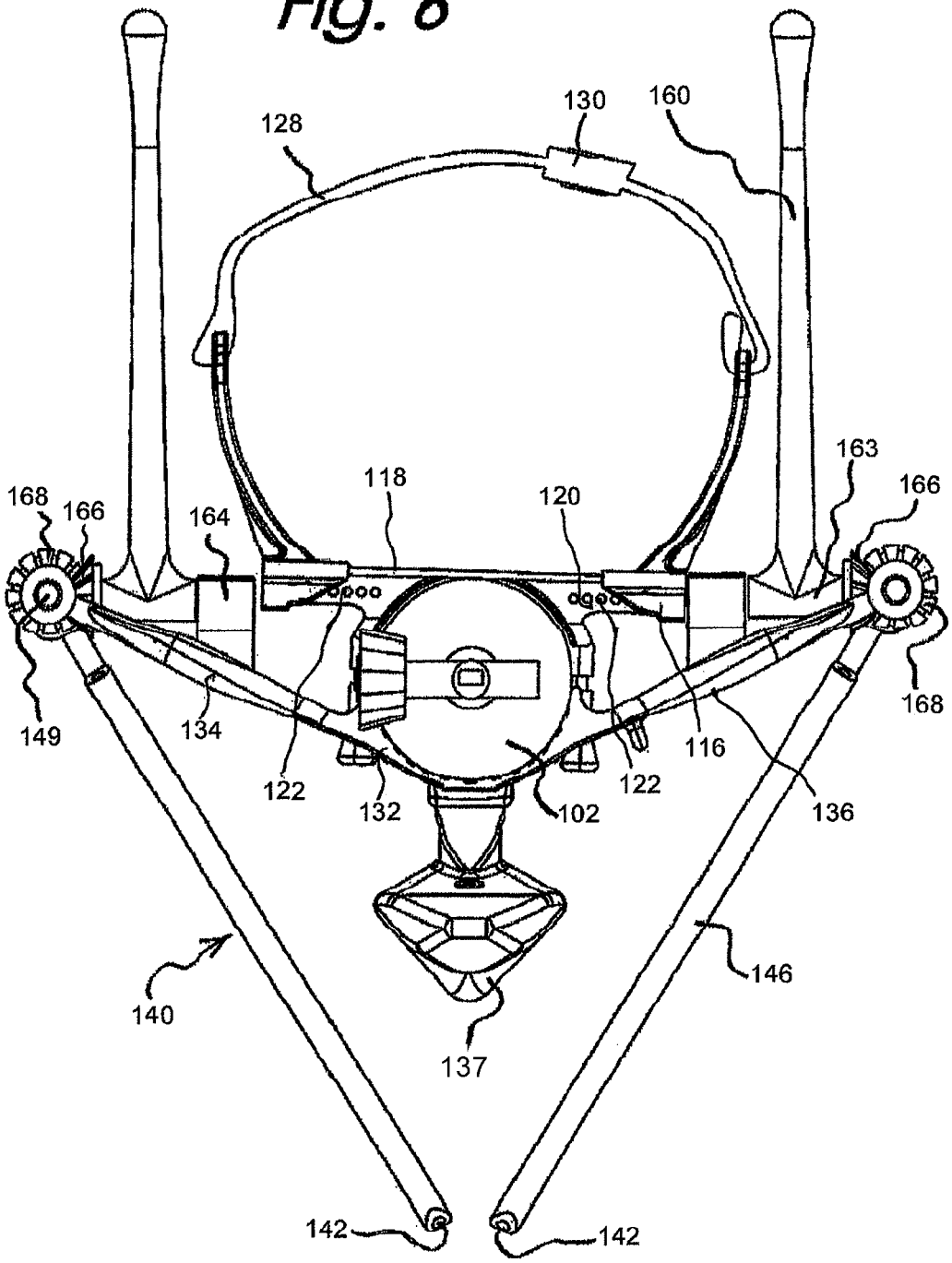
FIG. 6 is an end view of the scuba equipment shown in FIG. 1 taken in the direction indicated by line 6-6 of FIG. 5.

Referring now to FIG. 2, fins 140 may be rotatably connected to the left and right lateral portions 134, 136 of the clamp frame 106. The fins 140 may be secured to a respective fin mast 142 rigidly connected to a fin base 144. The elongated fin mast 142 may be received in a longitudinal borehole extending the length of each fin 140 proximate the forward edge 146 thereof. The fins 140 may be fixedly secured to respective fin masts 142. Each fin base 144 may be fixedly secured to a fin pivot shaft 149 which may be received in shaft bearings 138 at the distal ends of the left and right lateral portions 134, 136 of the clamp frame 106.

The propulsion apparatus 100 may include drive handles 160 to effectuate transverse oscillatory movement of the fins 140. One end 163 of the drive handles 160 may be journaled about a drive handle pivot shaft 162 having an end rotatably secured to a frame boss 164. The opposite end of the drive handle pivot shaft 162 terminates in a bevel gear 166 which cooperatively engages a fin bevel gear 168 fixedly secured to the fin base 144.

The fins 140 may comprise a substantially flat body that is thicker along its forward edge 146. The thickness of the fins 140 may gradually decrease from the forward edge 146 to the trailing edge 148. The stiffness or rigidity of the fins 140 is generally greater at the forward edge 146 and decreases toward the trailing edge 148. Combination of different materials in the manufacture of the fins 140 or other manufacturing means may alter the stiffness characteristics of the fins 144.

During operation of the propulsion apparatus 100, the scuba diver may grasp the drive handles 160 and moves them in a reciprocal fashion within a generally vertical plane to effectuate transverse oscillatory movement of the fins 140. Moving the drive handles 160 in unison typically results in straight forward propulsion, however, opposite reciprocal motion of the drive handles 160 may result in veering to one side or the other. During instances of steering, turning, or yaw control, only one drive handle 160 may be reciprocated. For example, and referring again to FIG. 1, during straight forward propulsion, left drive handle 160 is moved downward along path P about axis B, left fin 140 pivots laterally outward along path R. Similarly and simultaneously, during straight forward propulsion, as right drive handle 160 moves downward along path Q about axis B, right fin 140 pivots laterally outward along path S. As the scuba diver continues to reciprocate the drive handles 160 in unison, pulling up on the drive handles 160 pivots the fins 140 about right and left axes A and A' respectively while the fins 140 come together. In this manner the fins 140 operate as oscillating foils in the water with the resulting force vector providing forward propulsion. Generally, the first and second axes A and A' are longitudinally oriented with respect of the body of the scuba diver such that the stroking plane of the fins 140 are perpendicular to the long axis of the scuba diver, while the arms of the scuba diver have a stroking plane generally parallel to the long axis of the scuba diver. During straight line forward motion, where forward motion is defined as a motion directed from the scuba diver's feet to his head, arms and drive handles 160 are operated in unison causing the fins 140 to oscillate in opposition to each other while oscillating transversely. Lateral forces of the fins 140 are cancelled due to the oppositional motion of the fins 140 in the body of water, and thereby body roll that may be caused by the oscillating motion of the fins 140 is negligible.

While a preferred embodiment of the invention has been shown and described, other and further embodiments of the invention may be devised without departing from the basic scope thereof, and the scope thereof is determined by the claims which follow.

The invention claimed is:

1. A water propulsion apparatus, comprising:

a) a clamp frame, said clamp frame including a left portion, an intermediate portion and a right portion, said left portion and said right portion extending generally laterally outward from respective opposite lateral sides of said intermediate portion;

b) a left fin and a right fin rotatably secured to a respective said left portion and said right portion of said frame;

c) a left drive handle and a right drive handle operatively connected to a respective said left fin and said right fin;

d) a shaft bearing fixedly secured to a distal end of each said left portion and said right portion of said clamp frame; and e) wherein said left fin and said right fin are fixedly connected to a respective fin base rotatably connected to respective said left portion and said right portion of said clamp frame, wherein movement of said left drive handle and said right drive handle in a reciprocating motion generally transmits a torque force for oscillating said left fin and right fin transverse to the a center longitudinal axis of said clamp frame.

2. The propulsion apparatus of claim 1 including a fin bevel gear fixedly secured to each said fin base, each said fin bevel gear cooperatively engaging a respective drive handle bevel gear fixedly secured to each said left drive handle and said right drive handle.

3. The propulsion apparatus of claim 1 including a hip strap assembly having a base member, and further including adjustable arm members movably connected proximate a distal end of said base member.

4. The propulsion apparatus of claim 3 wherein each said arms members connect to a bracket movably coupled to a respective distal end of said base member.

5. The propulsion apparatus of claim 4 wherein each said bracket defines a substantially horizontally extending channel configured to receive a respective distal end of said base member.

6. The propulsion apparatus of claim 4 wherein said base member includes a ridge projecting outwardly substantially perpendicular to a back surface of said base member, said ridge including a plurality of through holes linearly arranged along said ridge.

7. The propulsion apparatus of claim 6 wherein each said bracket include a pair of sidewalls projecting outwardly in parallel relationship to one another, said pair of sidewalls defining a substantially vertical channel extending the length of each said bracket, said vertical channel configured to receive a respective ridge of said base member.

8. The propulsion apparatus of claim 7 wherein each said pair of sidewalls includes through holes linearly arranged along said pair of sidewalls.

9. The propulsion apparatus of claim 1 including a ballast float secured to said clamp frame.

* * * * *